United States Patent [19]

Tracy

[11] Patent Number: 4,589,645

[45] Date of Patent: May 20, 1986

[54] DOCUMENT SET SEPARATOR AND STACK HEIGHT SENSOR

[75] Inventor: Michael J. Tracy, Hilton, N.Y.

[73] Assignee: Xerox Corporation, Stamford, Conn.

[21] Appl. No.: 783,383

[22] Filed: Oct. 3, 1985

[51] Int. Cl.[4] ..... B65H 7/14

[52] U.S. Cl. ..... 271/3.1; 271/98; 271/154

[58] Field of Search ..... 271/3.1, 4, 5, 98, 99, 271/102, 31, 35, 165, 154, 155

[56] References Cited

U.S. PATENT DOCUMENTS 4,469,320 9/1984 Wenthe ..... 271/3.1 X 4,480,824 11/1984 Acquaviva ..... 271/3.1

*Primary Examiner*—Richard A. Schacher

[57] ABSTRACT

In a recirculating document handler for a copier for recirculating document sheets from a stack thereof in a document tray of the document handler to be copied and to be restacked therein after copying, with a document feeder for feeding the documents from the stack which is automatically controlled in response to sensing the approximate height of the stack and sensing each time the stack has been so recirculated, in response to the position of elevation relative to the stack of a set separator finger, the improvement in the sensing system comprising two spaced switches positioned to be variably actuated in response to variable positions of the set separator finger, and the set separator finger being adapted for actuating one, none, or both of the switches at respective different positions thereof, and a control providing six different automatic controls in response to four different combinations of sensed actuations or non-actuations of the two spaced switches and the operating times at which the combinations of actuations or non-actuations are sensed, to provide respective signals responsive to a stack which is too high for reliable feeding, a stack which is high, a medium height stack, a low stack and no stack or the end of a circulation of the stack. The set separator finger is reset on top of the stack, in response to one of these four combinations of actuations or non-actuations, with a rotatable lever arm pivotally connected with the set separator finger to move it horizontally therewith and having a cam surface thereon spaced and positioned to engage and lift the set separator finger above the stack only after a predetermined distance of rotation of the lever arm away from the stack and then to release it after a predetermined distance of rotation towards the stack.

7 Claims, 5 Drawing Figures

DOCUMENT SET SEPARATOR AND STACK HEIGHT SENSOR

Figure 1:
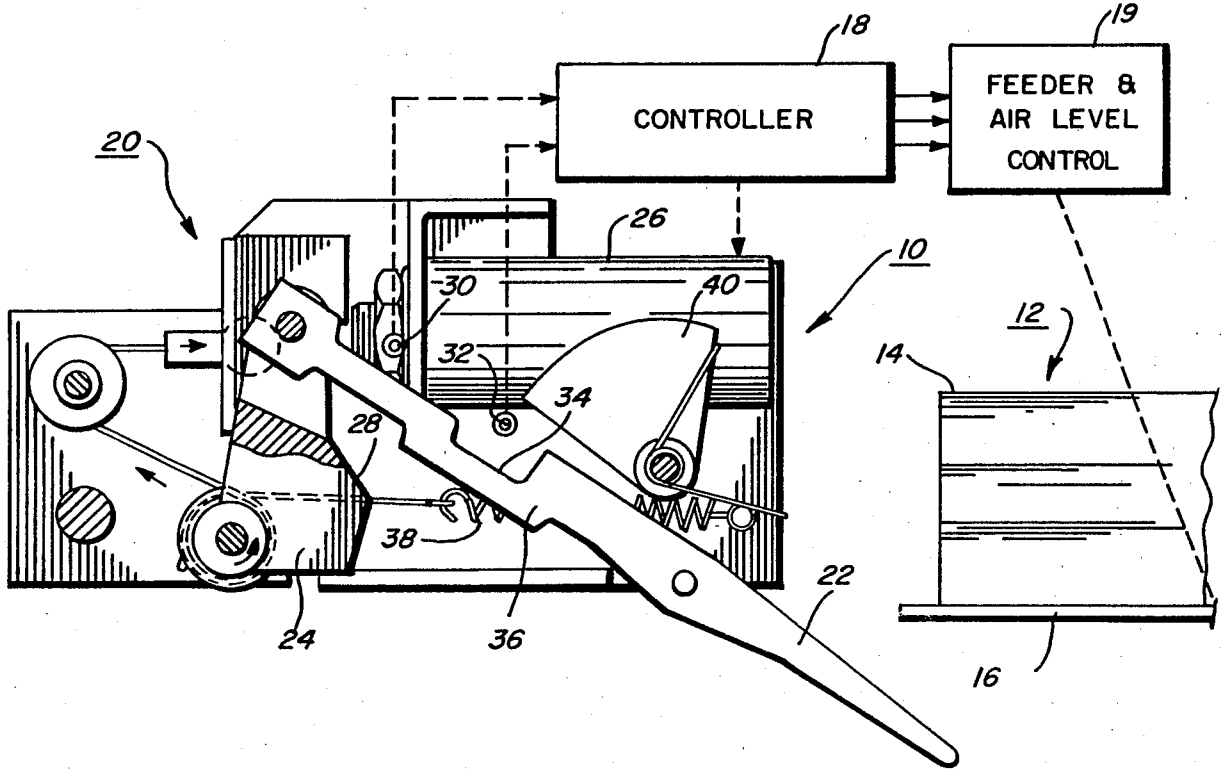

The present invention relates to an improved document set recirculating and stack height sensing system for a recirculating document handler for a copier.

As indicated, for example, in the "Xerox Disclosure Journal" publication Vol. 6, No. 4, July/August 1981, p. 167, in automatic recirculating document handlers, a document set separating finger or bail bar system is used to separate or distinguish those doument sheets to be fed from those which have been returned to the document tray following the copying operation. A finger or bail normally lightly rests on the document stack and moves down with gravity as the sheets are fed out from under the finger. When the finger is no longer over any documents it drops to activate a switch which signifies that all the documents have been copied. The finger or bail is then automatically reset to the top of the stack to initiate another feed cycle, by a solenoid or other drive mechanism which pulls the finger back and then lifts it up to the reset position. By employing a stack height sensor as a part of the same bail system, the reset position of the finger on the top of the stack can be utilized to give an indication of the stack height for automatically adjusting vacuum, air, or normal force pressures in the document feeder, to compensate for the weight or height of the stack. Variations in the stack height variably reposition the finger relative to a sensor. More than one sensor can be provided for the various potential reset positions of the finger.

The importance, applications and problems relating to such systems are particularly discussed in incorporated U.S. Pat. No. 4,469,320 issued Sept. 4, 1984 to S. J. Wenthe, over which this system is an improvement.

Although this document set separator art is well developed, as shown by the number of references cited above and below, the very number of different designs which have been utilized is indicative of reliability and other problems associated therewith.

The following exemplary art is noted on set separator (bail bar) systems per se, listed in numerical order; U.S. Pat. No. 3,556,513 issued Jan. 19, 1971 to A. Howard (Xerox); U.S. Pat. No. 3,815,896 issued June 11, 1974 to A. Hoyer (Xerox) (note especially FIGS. 7*a*–7*c*); U.S. Pat. No. 3,861,671 issued Jan. 21, 1975 to A. Hoyer (Xerox); U.S. Pat. No. 3,895,790 issued July 22, 1975 to A. Hoyer et al (Xerox); U.S. Pat. No. 3,941,376 issued Mar. 2, 1976 to K. Liechty, et al (Xerox); U.S. Pat. No. 3,954,259 issued May 4, 1976 to D. Gerbasi (Xerox); U.S. Pat. No. 4,078,787 issued Mar. 14, 1978 to Berlew et al (Eastman Kodak) (note Ref. Nos. 90, 91, 92, 125 and Col. 8, second paragraph, Col. 10, Paragraph No. 5 and Col. 11, first paragraph); U.S. Pat. No. 4,116,558 issued Sept. 26, 1978 to J. Adamek et al (Xerox) (note item 61, 61a, 61b); U.S. Pat. No. 4,164,347 issued Aug. 14, 1979 to T. McGrain (Eastman Kodak); U.S. Pat. No. 4,231,561 issued Nov. 4, 1980 to T. Kaneko et al (Ricoh) (note e.g. Col. 11, lines 35–46); U.S. Pat. No. 4,231,562 issued Nov. 4, 1980 to T. Hori (Savin); U.S. Pat. No. 4,433,836 issued Feb. 28, 1984 to W. J. Kulpa et al (Pitney Bowes); U.S. Pat. No. 4,451,138, issued May 29, 1984 to C. P. Anderson (Ricoh); U.K. Patent application GB 2,058,023A published Apr. 8, 1981 (Xerox); German OLS 2232023 laid open Jan. 17, 1974 by Licentia Patent-Verwaltungs GMBH; U.S.P.T.O. by W. E. Hunt (Eastman Kodak); the U.K. "Research Disclosure" Journal Publications Nos. 15842 of June 1977 and 20433 of April 1981; and the "Xerox Disclosure Journal", Vol. 5, No. 4 July/August 1980, p. 375, Vol. 5, No. 6, November/December 1980, pp. 625–6, and Vol. 8, No. 3, May/June 1983, pp. 189–190.

By way of further background, examples of other recirculating document handlers (RDH's) with which the present invention may be used include U.S. Pat. No. 4,278,344 issued July 14, 1981 to R. B. Sahay; U.S. Pat. No. 4,270,746 issued June 2, 1981 to T. J. Hamlin, and U.S. Pat. No. 4,076,408 issued Feb. 28, 1978 to M. G. Reid, et al. The latter patent includes an optical detector 149,151 in the document tray. A similar disclosure is in U.S. Pat. No. 4,099,860 issued July 11, 1978 to J. L. Connin.

The art also includes various other patents teaching various other document handlers and control systems therefor such as U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270 and 4,312,587.

Conventional simple software instructions in the copier's general microprocessor logic circuitry and software of all document handler and copier control functions and logic, as taught by the above and other patents and various commercial copiers, is well known and preferred. However, it will be appreciated that the document sensing and handling functions and controls described herein may be alternatively conventionally incorporated easily into any copier utilizing any other suitable or known simple software or hard wired logic systems, (e.g. simple combinations of registers or counters, "and" gates, "or" gates or the like), with conventional switches and solenoids, etc. Specific software instructions for functions described herein may vary somewhat depending on the particular microprocessor or microcomputer system and language utilized, of course, but is already available to or readily programmable by those skilled in the art without experimentation from the descriptions provided herein and in the above and other references.

All of the art and references cited herein, and their references, are incorporated by reference herein for appropriate teachings of additional or alternative details, features, and/or technical background.

As noted in the above-cited U.S. Pat. No. 4,469,320, for precollation copying, in a now-typical commercial recirculating document handler, a stack of original document sheets are placed in normal collated order in a stacking tray over a platen and then sequentially fed from the bottom of that tray to the copier platen where they are imaged onto a photoreceptor. After each original sheet has been copied, it is returned to the top of the stack in the stacking tray via a return feed path. Feeding the individual document sheets from the bottom of the stack around this loop or racetrack feed path without misfeeds or double-feeds or jams is difficult, particularly where the feeder disirably handles a variety of sizes, weights and conditions of paper sheets at high speeds.

With bottom sheet feeding, the weight of the overlying sheets of the stack greatly affects the feeding, even with the preferred pneumatic feeding systems cited herein. It has been found to be very desirable to control the air pressure level provided to the "air knife" sheet separator for such a bottom feeder for a copier. Some other examples of U.S. patents in this feeder technology are U.S. Pat. No. 4,269,406 issued May 26, 1981 to T.J. Hamlin, and U.S. Pat. No. 4,299,381 issued Nov. 10, 1981 to R. E. Smith. Further details of a preferred such air knife are disclosed in U.S. Pat. No. 4,418,905 issued Dec. 6, 1983 to G. M. Garavuso. Of particular interest, in regard to feeder air level controls are U.S. Pat. No. 4,336,928 issued June 29, 1982 to R. E. Smith et al, allowed U.S. Ser. No. 513,484 filed Aug. 13, 1983 by K. P. Moore and U.S. Ser. No. 526,924 filed Aug. 26, 1983. Also noted is "Xerox Disclosure Journal" publication Vol. 9, No. 5, September/October 1984, p. 301.

As taught in the previously-cited U.S. Pat. No. 4,469,320, setting or correlating the stack weight with the stack feeder air knife levels is important. If the air level is too high, and there are only a small number of sheets in the stack, these sheets may be excessively fluttered or blown and interfere with or prevent feeding. On the other hand, if the air knife level is too low, the weight of the overlying stack may cause misfeeding or double feeds from the bottom sheet feeder. If any sheets are misfed a jam or machine shutdown may occur. Since precollation copying, particularly for duplex copying, requires coordination of the feeding of the document sheets with the copy sheets, a misfeeding of documents can cause a shutdown condition for the entire copier, not just the document handler, and may require removal of copy sheets from the copy path and reorienting of the originals in order to accomplish "job recovery".

An important feature of the above-noted and other set separator systems is reliably detecting the feeding of all the sheets in the set from the stack support or tray area. This is needed to tell the system each time the complete document set is circulated, i.e. to keep track of the number of set circulations. This is typically coupled through the copier logic system to another sensor which counts the number of sheets being fed. With the combination of these two inputs or signals the number of document sheets in the document set can be readily determined after the first circulation. See, e.g., by way of further background, U.S. Pat. No. 4,278,344 issued July 14, 1981 to R. B. Sahay and the references cited therein. Such devices are known in the art as set counters, set separators or bail bars.

Such set separators may also be utilized in sheet feeding applications other than RDH systems. For example, they may be used for copy sheets being duplexed, as taught in U.K. published application G.B. 2,058,023A i.e. for keeping track of and separating duplex copy sheet sets being made in an automatic cuplex (2 sided) copier. The system disclosed herein may also be utilized in such other applications.

A preferred feature disclosed herein is to provide, in a recirculating document handler for a copier for recirculating document sheets from a stack thereof in a document tray of the document handler to be copied and to be restacked therein after copying, with a document feeder for feeding the documents from the stack which is automatically controlled in response to sensing means for sensing the approximate height of the stack and for sensing each time the stack has been so recirculated, in response to the position of elevation relative to said stack of a set separaor finger, the improvement in said sensing comprising:

two spaced switch means positioned to be variably actuated in response to variable positions of said set separator finger and switch actuating means connecting with said set separator finger for actuating one, none, or both of said switch means at respective different positions thereof, and control means for providing six different said automatic controls in reponse to four different combinations of sensed actuations or non-actuations of said two spaced switch means and the operating times at which said combinations of actuations or non-actuations are sensed.

Further features and details disclosed herein include those wherein said sensing means includes means for withdrawing said set separator finger of said sensing means away from the stack and resetting it on top of the stack in response to one of said four combinations of actuations or non-actuations of said switch means with a rotatable lever arm pivotally connected with said set separator finger to move it horizontally therewith and a cam surface on said lever arm spaced and positioned to engage said set separator finger and lift it automatically above said stack only after a predetermined distance of rotation of said lever arm away from said stack and not after a predetermined distance of rotation towards said stack, and wherein said conrol means for providing six different said automatic controls in response to four different combinations of actuations or non-actuations of said two spaced switch means, to provide respective signals responsive to a stack which is too high for reliable feeding, a stack which is high, a medium height stack, a low stack, no stack, or the end of a circulation of the stack.

Further desirable features and advantages pertain to the specific apparatus and steps of operation whereby the above-mentioned and other features and advantages may be attained, including the specific example described hereinbelow which includes the following drawing figures (approximately to scale) wherein:

FIG. 1 is a front view of one embodiment of a document stack-sensing system in accordance with the present invention; and FIGS. 2–5 are partial (simplified) front views of the embodiment of FIG. 1, showing different positions of the operation thereof.

Disclosed here is a document feeding control system 10 for controlling the feeding of a document handling system 12 such as disclosed, for example, in U.S. Pat. No. 4,418,905 and with a controlled air knife as disclosed for example in the U.S. Pat. No. 4,336,928 or 4,469,320 or Ser. No. 513,484 or Ser. No. 426,924, all cited above.

The exemplary document handling system or RDH 12 per se is partially disclosed in FIGS. 1–5 as including the rear of document stack 14 and tray 16 and feeder and air level control 19. The RDH 12 may be conventional and may be mounted to, as a part of, any conventional copier. Furthermore, the present system is applicable to numerous other sheet feeding systems, of which this is merely one example. Further details are described in the above-cited and other references, and need not be repeated herein.

This otherwise conventional document feeding system 12 here is a recirculating document sheet handler for precollation copying, in which a stack 14 of individual flimsy document sheets are loaded into the generally horizontal and planar bottom surface of a restacking tray 16 to be fed seriatim from the bottom of the stack 14 by a vacuum belt or other individual sheet output feeder, assisted by an air knife, both of which are adjacent the front or downstream edge of the stack. Each sheet, after it has been fed out to the copier platen and copied, is returned via a restacking feeder or transport which feeds the returning sheet in over the top of the stack from the rear of the stack and releases the sheet to restack by settling down on top of the stack between aligning edge guides. Thus, the sheets can be continuously recirculated, in the same order, as often as desired.

Referring now to the overall sensing and control system embodiment 10, integral the automatic recirculating document handler 12, the system 10 includes a set separator unit 20 for set separation, i.e. for distinguishing those documents in stack 14 to be fed from those which have been returned to the document tray 16 and restacked. An integral finger or bail 22 normally rests on the stack 14 lightly and moves down with gravity as sheets are fed out from the bottom of the stack, and therefore fed out from under the finger 22. When the finger 22 is no longer over any documents it drops through a slot in the tray 16 bottom into a position to activate a photoswitch which signifies that all the document sheets in the set have been copied once, i.e. circulated once. The finger 22 is then automatically reset to an initial or reset position on top of the stack, to initiate another cycle, by a solenoid actuating mechanism. The sensed reset position of the finger 22 on the top of the stack 14 is utilized to provide an indication of the stack height, for automatically adjusting vacuum, air, and/or normal force pressures in the document feeder to compensate for the height (and therefore indirectly for the weight) of the stack, as further described, for example in U.S. Pat. No. 4,469,320, cited above.

Describing first the mechanical structure and operation of the integral document set separator/circulation counter and stack height sensing system 10, it is located centrally in the rear or restacking end of the document tray 16 of the RDH 12. The set separator unit 20 of the system 10 has its finger, arm or bail 22 controlled directly and solely by its eccentric pivotal connection to a single rotated arm or sector 24, with a cam 28, providing all of the required movements of retraction, lifting, re-extension and dropping of the bail or finger 22. This is an improved design in which the separator finger 22 is lifted out further over the stack 14, and exerts less horizontal force on the stack 14, and is held more horizontally, and reduces the chances of false readings from curled edge documents, and reduces shingling and subsequent misfeeds. With the separator unit 20 positioned mid-rear of the stack 14, it does not cause twisting of the stack. It reduces the potential for document sheet skew compared to prior art side-positioned stack separators. The unit 20 is more positively driven by its arm 24 and its cam 28 through the reset cycle, yet the design is efficient and low cost. The positive drive and repositioning also improves the precision of stack height sensing. The increased length of the separator finger 22 decreases the angle in which it rests on the document stack. This particularly reduces the chances of undesirable document shingling, i.e. document sheets sliding forward down the finger 22 as they restack in the tray 16 on top of the finger.

The bail arm or finger 22 is returned to the top of the document stack with a minimum number of parts. The finger 22 is pivotally connected at all times to the rotary arm or sector 24, which is rotated by a cable pulley attached to it. The arm 24 and its integral cam 28 is partially rotated, by approximately 60 degrees, by means of a solenoid 26 via the cable attached to the pulley. For the first 25 degrees, the finger 22 is pulled back basically horizontally. The finger 22 is moved about one-half of its total retraction before it begins any upward movement, to ensure that it is well behind the stack before it is lifted. Then in the final 35 degrees, the finger 22 is lifted up, by the cam 28. A spring action then returns the solenoid and propels the arm through its return path back out over the document stack. The sensors are diraectly tripped by the bail 22 itself, making the document height sensing more precise.

To re-express the above, the disclosed document set separator unit 20 has a finger or elongated bail 22 having one end thereof eccentrically mounted to an oscillating solenoid driven arm or disc 24. This arm 24 has a cam surface 28 oscillating therewith which operates intermittently on an intermediate portion of the finger 22. This combination drive provides, first, a quasi-linear retraction of the previously dropped separator finger or bail 22 away from under the end of the stack 14, then its arcuate elevation, once free of the end of the stack, and then its quasi-linear return (preferably with the aid of an elevation retaining cam surface or magnet) back out over the top of the stack, extending the finger 22 out over (above) the stack without contacting it, and then dropping it down onto the top of the staek, well away from the edge, unconstrained, so that it drops onto the upper surface level of that particular stack.

A simple and inexpensive linear (or rotary) solenoid 26 may be used, preferably with a connecting cable, pulley, and spring 38 arrangement as shown in FIG. 1, so that retraction of the bail 22 away from the stack is by the solenoid 26 pull-in, while return movement is by the opposing spring force rotating the arm 24 back towards the stack (in the opposite direction).

About one-half of the total travel of the bail 22 is basically horizontal only. This travel is provided for the bail 22 in its initial retraction movement away from the end of the stack. This insures that the end of the finger 22 is pulled all the way out from under the end of the stack 14 before any lifting of the finger 22 is initiated.

Note that the unique shape of the central portion of the arm or bail 22 itself controls the blocking and unblocking of two commercial photo-optical pair sensors 30 and 32. These are an upper, stack height, sensor 30, and a lower, set separator, sensor 32. Specifically, there is provided a preformed notch 34 on one side of the finger 22 and a projecting tab 36 on the opposite side. It will be appreciated that other suitable configurations may be provided. There is a preset vertical distance (arm 22 width) therebetween relative to the vertical distance between the two sensors 30 and 32, and a preset horizontal extent of both the notch 34 and tab 36. The horizontal extent thereof controls the blocking or unblocking of the sensors during the reset operation, when the arm is being fully retracted, as will be explained. The tab 36 and notch 34 enable the two sensors to be further apart and less critical as to arm movement position, i.e. provide a more accurate stack height indication less affected by the sensor mounting positions, for more accurate input to their connecting input to the conventional microprocessor conroller 18, which in turn controls the stack feeder 19, particularly the air level control thereof, as described in the above-referenced patents, and as schematically illustrated in FIG. 1.

The two spaced sensors or switch means 30 and 32 are positioned to be variably actuated by the notch 34 and tab 36 in response to variable positions of the set separator finger 22 for actuating one, none, or both of said sensors 30 and/or 32 at respective vertical (and horizontal) positions thereof. In response thereto, the controller 18 provides at least five, and potentially six, different automatic control outputs 19 in reponse to four different combinations of sensed actuations or non-actuations of said two spaced sensors 30 and 32 and the operating times at which said combinations of actuations or non-actuations are sensed. These six different automatic conrols in reponse to four different combinations of sensor actuations or non-actuations provide respective signals responsive to a stack which is too high for reliable feeding, a stack which is high, a medium height stack, a low stack, no stack, or the end of a circulation of the stack.

In response to one of said four combinations of actuations or non-actuations of said switch means the solenoid 26 is actuated by controller 18 to withdraw set separator finger 22 from the stack 14 and reset it on top of the stack, with the rotatable lever arm 24 pivotally connected with finger 22 to move it horizontally therewith, and the cam surface 28 on the lever arm 24 spaced and positioned to engage the finger 22 and lift it automatically above the stack 14 only after a predetermined distance of rotation of the lever arm 24 away from said stack, then release it after a predetermined distance of rotation back towards said stack. The arm 24 is so rotated back by spring 38 after the conroller 18 removes power from solenoid 26.

Figure 2:
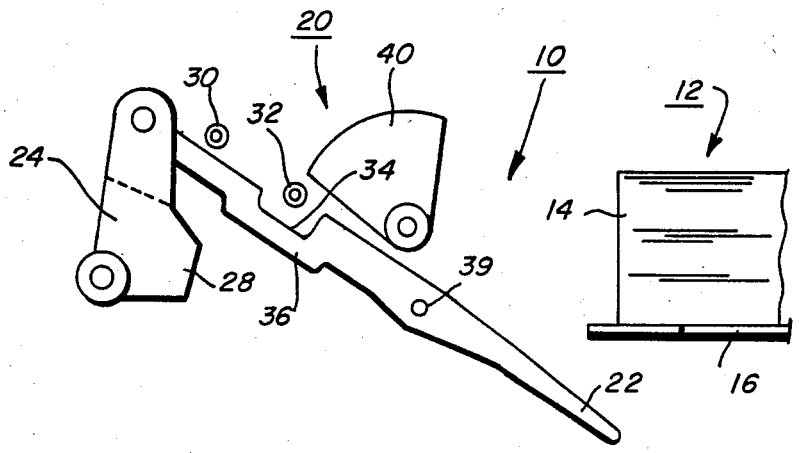
Figure 3:
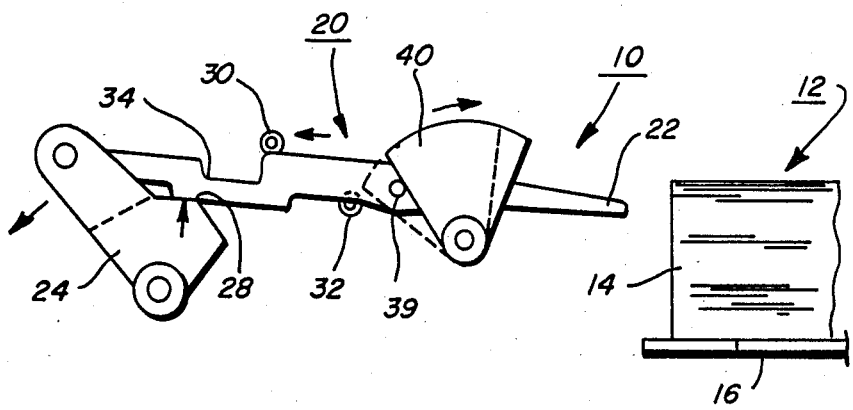
Figure 4:
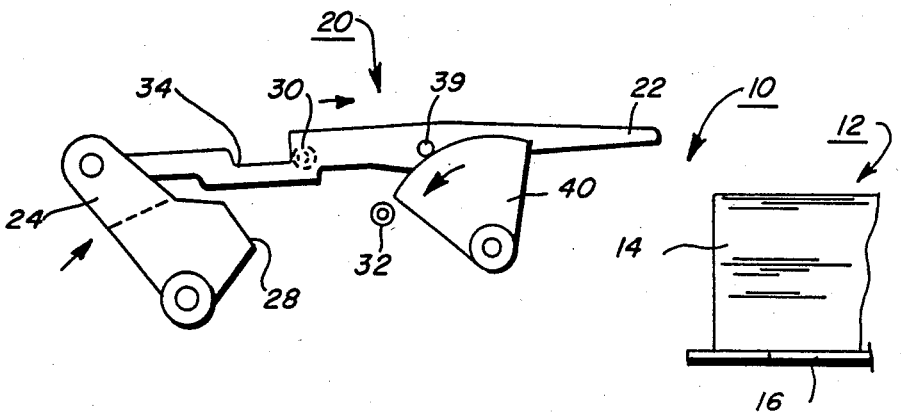
Figure 5:
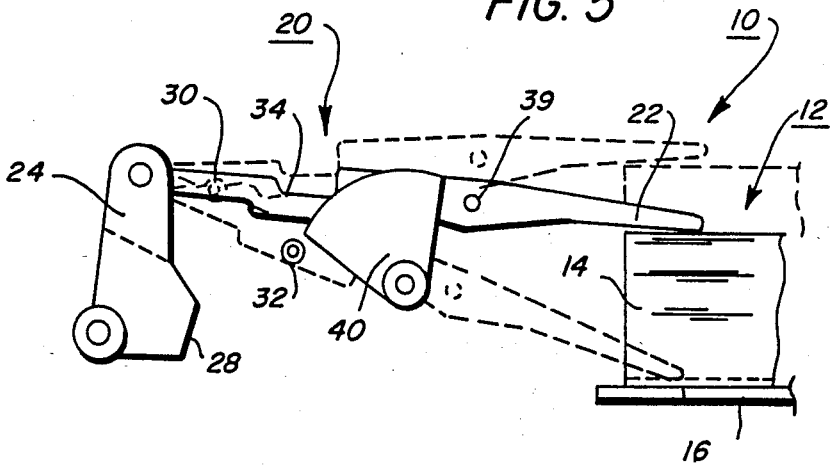

Referring now particularly to the various operating positions of the system 10 variously illustrated in FIGS. 1–5, FIGS. 1 and 2 show the system after finger 22 has dropped through the slot in tray 16 as described above, and just as it is about to be reset. FIG. 3 shows the system near the end of the finger 22 retraction step of the resetting operation, as the cam 28 is lifting the finger 22 vertically. FIG. 4 illustrates the return movement of this resetting operation. FIG. 5 illustrates the finger 22 in its returned (reset) stack height sensing position, for three different stack heights.

In the end-of-set (or no document present) position of FIGS. 1 and 2, it may be seen that both sensors 30 and 32 are uncovered or unoccluded. That is, the opposing light source for each sensor reaches each sensor without blockage by any portion of the set separator finger 22 being therebetween. This starts or initiates the resetting cycle shown in FIGS. 1, 2, 3 and 4.

By conducting a resetting cycle before copying, i.e. when the "START PRINT" or "COPY" button on the copier console is pressed, the system 10 can determine in combination with this same set of signal conditions from sensors 30 and 32 that no documents are present in the RDH 12 tray 16, because in that case the finger 22 will redrop immediately into its dropped position of FIGS. 1 and 2. But when this does not occur until after feeding of at least one document from tray 16 then these same signals provide a different indication and function—an end of set circulation indication.

For the resetting cycle, the finger 22 retraction movement is started as shown by the movement arrows in FIG. 1 by the pull-in of solenoid 26 pulling on the cable connecting with the pulley on the pivotal axis of arm 24. Arm 24 pulls back finger 22 horizontally until the cam surface 28 on arm 24 is rotated up under finger 22 to begin lifting finger 22 upwardly as shown in FIG. 3.

At the end of the pull-in stroke of solenoid 26, a pin 39 on finger 22 is lifted up above the rear lip of an additional (optional) return cam 40. The cam 40 is pivotally spring-loaded to positively snap back under the pin 39 at that point (see the dashed-line position of cam 40 in FIG. 3 and the solid line position thereof in FIG. 4). Thus when current is removed from solenoid 26, spring 38 rotates arm 24 forward, as shown in FIG. 4, and pin 39 rides up over the top of cam 40 to hold finger 22 up above the highest possible stack 14, and the finger 22 is advanced out over and above stack 14. When pin 39 reaches the end of the cam 40 cam surface the finger 22 is then free to drop down vertically onto the top of the stack, down to whatever the height of that stack may be, and at a position well beyond the stack edge, so as not to read or be affected by any edge curls in the documents at the edge of the stack.

Even in the above-described resetting operation, the sensors 30 and 32 serve a function. The controller 18 logic "looks" at the inputs from these sensors, at the time it is providing the actuating signal to the solenoid 26, to check for occlusion of the upper sensor 30 and not the lower sensor 32, as shown in FIG. 4. When that combination of 3 signals occurs, the conroller 18 knows that the finger 22 has been lifted up or "cocked" by cam 28 and is in the correct position for release of solenoid power for the return or resetting movement of finger 22. Note that this is accomplished by terminating the notch 34 in finger 22 at a position relative to the "cocked" position of finger 22 such that an unnotched portion of finger 22 will block sensor 30. Note also that sensor 30 is positioned horizontally rearwardly of sensor 32, as well as vertically spaced thereabove. The combination of a solenoid operating signal and blockage of only sensor 30 signals the release of finger 22 to immediately fly forward and then immediately drop to detect stack height, if any.

As the outer or height-sensing end of the finger 22 drops onto the stack, the inner portion thereof including tab 36 correspondingly drops sequentially past the sensors 30 and 32 to provide stack height sensing information, as will be described with reference to FIG. 5.

Assume first an "overstack" condition, as shown by the uppermost dashed-line positions of stack 14 and finger 22 in FIG. 5. In that condition (too many documents for reliable document feeding) neither sensor 30 nor sensor 32 will be occluded. The finger 22 dropping motion is stopped before it drops far enough for ringer 22 to even cover upper sensor 30. Note that in this position the tab 36 is now forward of sensor 30 and cannot intercept sensor 30.

A stack 14 level which is high, but not overstacked, is exemplified by the solid line positions in FIG. 5. There is a preset range of such "high" stack levels, which is sensed by occlusion of only sensor 30 but not sensor 32, as shown. This provides a "heavy" stack signal output from controller 18 to provide a higher level air-knife level control 19. This "high" (but not "overstack") range may be, for example, for stack heights of from 25 mm to 6.5 mm.

If the stack 14 height is in a "medium" range, (not illustrated) the system 10 is designed so that both sensors 30 and 32 are occluded in this range. In this "medium" stack range, tab 36 covers sensor 32, yet sensor 30 also remains covered by the rear of finger 22. This "medium" stack height range extends over a range of finger 22 initial rest positions from the above-described "high" range up to a "low" stack position. This "medium" stack height range may be, e.g. for stack heights of from 6.5 mm to 1.5 mm, and results in corresponding medium level air control.

"Low" stack heights are illustrated by the lower dashed line position of finger 22 and stack 14 in FIG. 5. For "low" stacks only the lower sensor 32 is occluded, and the upper sensor 30 is now uncovered. This 32 but not 30 signal combination tells the controller 18 that some, but only a small number, of sheets are in tray 16, and the air knife pressure level 19 is reduced accordingly to avoid over-fluffing the small stack.

If the finger 22 drops down to the FIG. 1 or 2 position immediately after the resetting operation, then the controller knows that there is no stack present, i.e. no documents have been loaded, or they had all been removed from the tray. In contrast, if this occurs *after* a normal reset to one of the stack height positions, it provides an end of circulation signal.

Thus it may be seen that the present invention automatically provides a correct variable pneumatic setting for sheet feeding, including an accurate air knife level for the particular thickness of the sheet stack being fed, thereby minimizing misfeeds or jams.

It will be appreciated that the embodiment described herein is merely exemplary, and the numerous other variations, modifications, refinements or alternatives will be apparent to those skilled in the art from the disclosures herein. They are intended to be encompassed by the following claims:

What is claimed is:

1. In a recirculating document handler for a copier for recirculating document sheets from a stack thereof in a document tray of the document handler to be copied and to be restacked therein after copying, with a document feeder for feeding the documents from the stack which is automatically controlled in response to sensing means for sensing the approximate height of the stack and for sensing each time the stack has been so recirculated, in response to the position of elevation relative to said stack of a set separator finger, the improvement comprising:

two spaced switch means positioned to be variably actuated in response to varible positions of said set separator finger, by switch actuating means integral said set separator finger, for actuating one, none, or both of said switch means at respective different positions thereof, and control means for providing at least five different said automatic controls in reponse to four different combinations of sensed actuations or non-actuations of said two spaced switch means and the operating times at which said combinations of actuations or non-actuations are sensed.

2. The recirculating document handler of claim 1 wherein said sensing means includes means for withdrawing said set separator finger of said sensing means away from the stack and resetting it on top of the stack in response to one of said four combinations of actuations or non-actuations of said switch means with a rotatable lever arm pivotally connected with said set separator finger to move it horizontally therewith and a cam surface on said lever arm spaced and positioned to engage said set separator finger and lift it automatically above said stack only after a predetermined distance of rotation of said lever arm away from said stack and to release said set separator finger after a predetermined distance of rotation towards said stack.

3. The recirculating document handler of claim 1 wherein said control means provides six different said automatic controls in reponse to four different combinations of actuations or non-actuations of said two spaced switch means, to provide respective signals responsive to a stack which is too high for reliable feeding, a stack which is high, a medium height stack, a low stack, no stack, or the end of a circulation of a stack.

4. The recirculating document handler of claim 3 wherein said sensing means includes means for withdrawing said set separator finger of said sensing means away from the stack and resetting it on top of the stack in response to one of said four combinations of actuations or non-actuations of said switch means with a rotatable lever arm pivotally connected with said set separator finger to move it horizontally therewith and a cam surface on said lever arm spaced and positioned to engage said set separator finger and lift it automatically above said stack only after a predetermined distance of rotation of said lever arm away from said stack and to release said set separator finger after a predetermined distance of rotation towards said stack.

5. The recirculating document handler of claim 1 wherein said switch actuating means are irregularly shaped for different actuations of said switch means in response to both the horizontal an vertical positions of said set separator finger.

6. The recirculating document handler of claim 3 wherein said switch actuating means are irregularly shaped for different actuations of said switch means in response to both the horizontal and vertical positions of said set separator finger.

7. The recirculating document handler of claim 4 wherein said switch actuating means are irregularly shaped for different actuations of said switch means in response to both the horizontal and vertical positions of said set separator finger.

* * * * *